US010005630B2

(12) United States Patent
Shiina et al.

(10) Patent No.: US 10,005,630 B2
(45) Date of Patent: Jun. 26, 2018

(54) SHEET CONVEYANCE APPARATUS AND IMAGE FORMING APPARATUS

(71) Applicant: CANON KABUSHIKI KAISHA, Tokyo (JP)

(72) Inventors: Sachiyori Shiina, Mishima (JP); Hiroyuki Matsumoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/388,219

(22) Filed: Dec. 22, 2016

(65) Prior Publication Data

US 2017/0183177 A1 Jun. 29, 2017

(30) Foreign Application Priority Data

Dec. 28, 2015 (JP) ..... 2015-256506

(51) Int. Cl.
*B65H 5/36* (2006.01)
*B65H 3/06* (2006.01)
(Continued)

(52) U.S. Cl.
CPC ..... *B65H 5/36* (2013.01); *B65H 3/06* (2013.01); *B65H 5/062* (2013.01); *B65H 29/58* (2013.01);
(Continued)

(58) Field of Classification Search
CPC .. B65H 29/58; B65H 29/60; B65H 2301/448; B65H 2402/31; B65H 2403/541;
(Continued)

(56) References Cited

U.S. PATENT DOCUMENTS

2002/0014737 A1* 2/2002 Yoshida ..... B65H 29/60 271/225
2009/0302524 A1* 12/2009 Hirai ..... B65H 29/58 271/81
(Continued)

FOREIGN PATENT DOCUMENTS

JP 9-236163 A 9/1997
JP 2004-292167 A 10/2004
(Continued)

*Primary Examiner* — David H Bollinger
(74) *Attorney, Agent, or Firm* — Canon U.S.A., Inc. IP Division

(57) ABSTRACT

A sheet conveyance apparatus includes a guide member, a holding member, and urging members. The guide member can move between a first position to guide a conveyed sheet toward a first conveyance path and a second position to guide the conveyed sheet toward a second conveyance path. A first urging member applying applies an urging force to the holding member so that the guide member is held at the first position. The second urging member applies, to the guide member, an urging force to move the guide member from the first to the second position. The holding member is movable between a hold position at which the guide member is held and a release position in which the holding member releases the guide member. When the holding member is at the release position, the guide member is held at the second position by the second urging member urging force.

10 Claims, 9 Drawing Sheets

(51) Int. Cl.

| | |
|---|---|
| ***B65H 5/06*** | (2006.01) |
| ***B65H 29/58*** | (2006.01) |
| ***B65H 85/00*** | (2006.01) |
| ***G03G 15/00*** | (2006.01) |

(52) U.S. Cl.
CPC ..... *B65H 85/00* (2013.01); *G03G 15/6529* (2013.01); *B65H 2301/33312* (2013.01); *B65H 2403/421* (2013.01); *B65H 2403/53* (2013.01); *B65H 2404/611* (2013.01); *B65H 2404/632* (2013.01); *G03G 2215/00675* (2013.01)

(58) Field of Classification Search
CPC ..... B65H 2404/63; B65H 2404/632; B65H 2404/7414
USPC ..... 271/303
See application file for complete search history.

(56) References Cited

U.S. PATENT DOCUMENTS

2014/0159303 A1* 6/2014 Suzuki ..... G03G 15/234 271/225
2016/0378044 A1* 12/2016 Naoi ..... B65H 29/125 271/225

FOREIGN PATENT DOCUMENTS

JP 2007-91359 A 4/2007
JP 2009-120345 A 6/2009

* cited by examiner

SHEET CONVEYANCE APPARATUS AND IMAGE FORMING APPARATUS

BACKGROUND OF THE INVENTION

Field of the Invention

An embodiment relates to a sheet conveyance apparatus for conveying a sheet and an image forming apparatus including the sheet conveyance apparatus.

Description of the Related Art

An image forming apparatus, such as an electrophotographic copying machine and an electrophotographic printer, includes an apparatus for switching the sheet conveyance direction at a branching portion between sheet conveyance paths. Such a switching apparatus provided with a guide member at the branching portion, where the position of the guide member is switched by a plunger type solenoid, is known. As a switching apparatus, a gate type sheet conveyance path switching apparatus is widely used. In the switching apparatus, the entrance of a conveyance path different from a selected conveyance path is closed, and a sheet is fed to the selected conveyance path. A plunger type solenoid is composed of a slidable iron core and a wire wound around the iron core in coil form. When a current is supplied to the wire, a magnetic field is generated to slide the iron core.

In an image forming apparatus, a guide member is provided at a branching portion between a sheet discharge conveyance path communicating with a discharge tray and a sheet reversing conveyance path communicating with a reversing tray. The guide member stands by being urged in one direction by a tension spring. The plunger type solenoid and the guide member are connected with each other via a link member. The plunger type solenoid is not supplied with a current. In this state, a conveyed sheet is guided to the sheet discharge conveyance path. When the plunger type solenoid is supplied with a current, the plunger slid by the absorption force generated by electromagnetic power and the guide member is rotated (swung) via the link member. At the time of two-sided conveyance, the plunger type solenoid repetitively turns ON and OFF to control the guide member to suitably switch the sheet conveyance direction.

Japanese Patent Application Laid-Open No. 2009-120345 discusses an apparatus having a similar configuration to the above-described configuration in which conveyance paths are switched therebetween by a plunger type solenoid. The technique discussed in Japanese Patent Application Laid-Open No. 2009-120345 aims at reducing abnormal sound occurring when a guide member is rotating. More specifically, the apparatus decreases the rotational (swinging) speed at which the guide member contacts an abutting portion by switching a current supplied to the solenoid, thus restricting collision sound.

In recent years, noise reduction is demanded while the operation speed of printers has been increased. Accordingly, there is a demand for shortening the distance between sheets (hereinbelow, referred to as a "sheet interval") in continuous sheet conveyance (sheet interval reduction) to increase the number of sheets printed per minute to a maximum extent without increasing the number of rotations of a driving rotator such as a motor as much as possible. When performing two-sided printing with paper feed at shortened (reduced) sheet intervals (short sheet interval feed), is necessary to operate the guide member at short sheet intervals. When switching the guide member by using a plunger type solenoid, the following issues may arise.

For example, if the sheet interval is extremely reduced, it becomes difficult to switch the guide member between sheets. Conventionally, the time required for the sheet interval was longer than the switching time of the guide member. Therefore, it was possible to switch the guide member after the preceding sheet passes and to complete the switching operation before the following sheet reaches the guide member. However, in a case of sheet conveyance at short sheet intervals of about 30 milliseconds (ms), for example, it is very difficult to start and complete the guide member operation in such a short time.

As a method for reliably switching between sheet conveyance paths in conveyance at short sheet intervals, there is proposed a technique for starting the guide member operation while the preceding sheet is being conveyed. If the timing of starting the guide member operation brought forward in this way, most of the rotation operation of the guide member is completed at the timing when the trailing edge of the preceding sheet passes the leading end of the guide member. After the trailing edge of the preceding sheet passes the guide member, when the guide member performs the remaining rotation operation, the conveyance path switching is completed.

Suppose an example case where the timing of starting the guide member operation by a plunger type solenoid is brought forward and the guide member stands by in contact with the preceding sheet. After the trailing edge of the preceding sheet passes the guide member, when the guide member rotates by the sheet thickness, the preparation for guiding the following sheet toward the other conveyance path is completed. Therefore, although the conveyance path switching operation is reliably completed even at very short sheet intervals, the guide member switched by the plunger type solenoid contacts the sheet being conveyed with a comparatively strong force, fixed image is strongly rubbed, possibly resulting in an image failure.

Using a plunger type solenoid has an issue of difficulty in setting and managing the absorption force since the absorption force of the solenoid serves as a sheet contact pressure.

SUMMARY OF THE INVENTION

According to an aspect of the present invention, a sheet conveyance apparatus includes a conveyance unit configured to convey a sheet, a guide member configured to be movable between a first position in which the guide member guides the sheet conveyed by the conveyance unit toward a first conveyance path and a second position in which the guide member guides the sheet by the conveyance unit toward a second conveyance path, a holding member for holding the guide member at the first position, a first urging member configured to apply an urging force to the holding member so that the guide member is held at the first position, and a second urging member configured to apply, to the guide member, an urging force in a direction for moving the guide member from the first position to the second position, wherein the holding member is movable between a hold position in which the holding member holds the guide member at the first position against the urging force of the second urging member and a release position in which the holding member releases a holding of the guide member, and wherein, when the holding member is at the release position, the guide member is held at the second position by the urging force of the second urging member.

Further features of the present invention will become apparent from the following description of exemplary embodiments with reference to the attached drawings.

DESCRIPTION OF THE EMBODIMENTS

Figure 1:
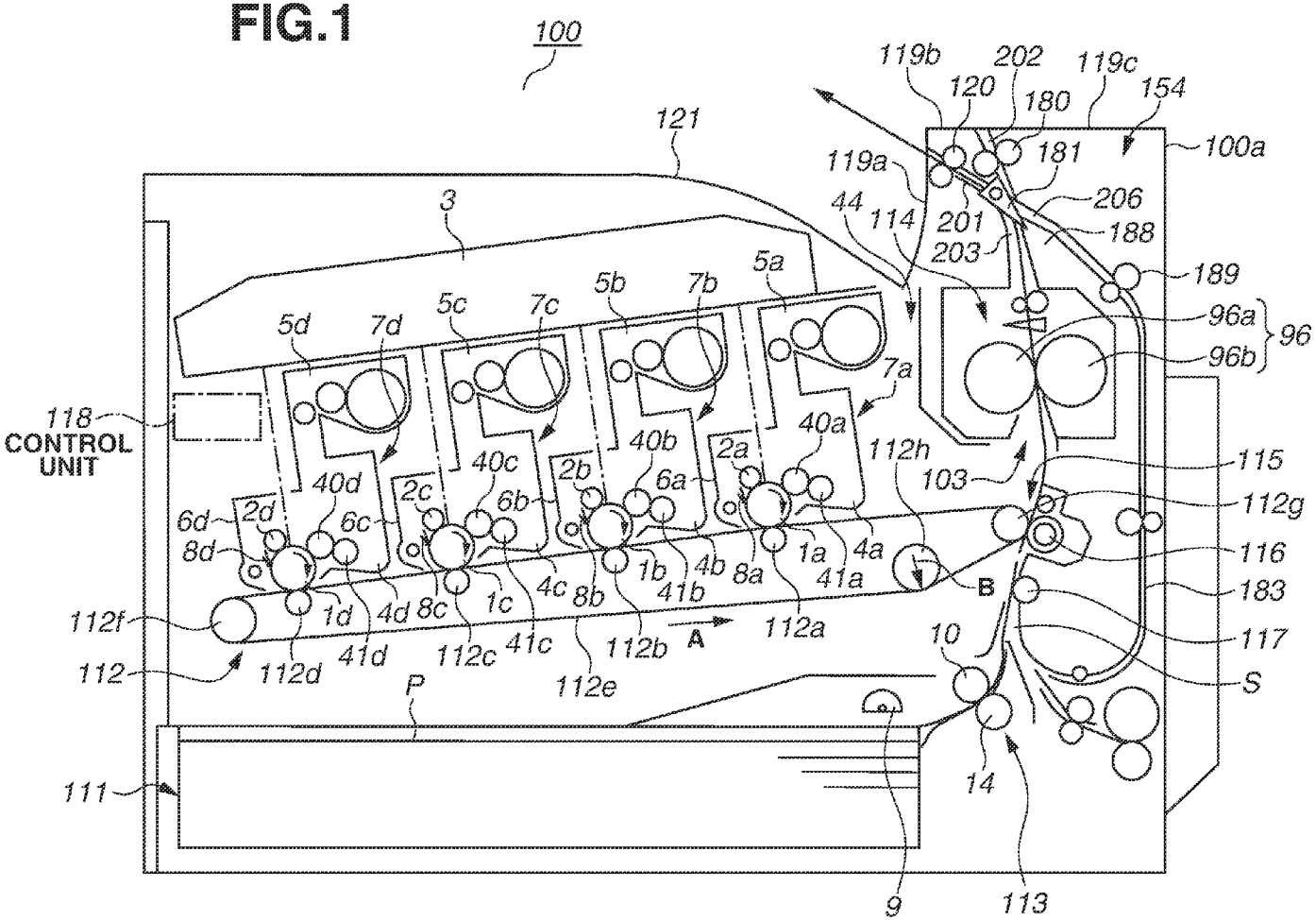
FIG. 1 is a section diagram schematically illustrating a configuration of an image forming apparatus including a sheet conveyance apparatus according to a first exemplary embodiment.

A sheet conveyance apparatus 154 including switching apparatus 205 and an image forming apparatus 100 including the sheet conveyance apparatus 154 according to a first exemplary embodiment will be described below. FIG. 1 is a section diagram illustrating a configuration of the image forming apparatus including the switching apparatus 205. In a second exemplary embodiment (described below), common elements will be similarly referenced.

<Image Forming Apparatus>

First, the overall configuration of the image forming apparatus 100 according to the first exemplary embodiment will be described. The color image forming apparatus 100 illustrated in FIG. 1 includes an image forming apparatus main body (hereinbelow, referred to an apparatus main body) 100*a*. The apparatus main body 100*a* includes an image forming unit 44, the sheet conveyance apparatus 154, and a control unit 118 as a control unit for controlling each part of the image forming apparatus 100. The image forming unit 44 includes process cartridges 7*a*, 7*b*, 7*c*, and 7*d* detachably attached to the apparatus main body 100*a*. Although the four process cartridges 7*a*, 7*b*, 7*c*, and 7*d* have the same structure, they differ from each other in forming images by using toner of different colors: yellow (Y), magenta (M), cyan (C), and black (Bk), respectively. The process cartridges 7*a*, 7*b*, 7*c*, and 7*d* include development units 4*a*, 4*b*, 4*c*, and 4*d* and toner units 5*a*, 5*b*, 5*c*, and 5*d*, respectively. The development units 4*a* to 4*d* include photosensitive drums 1*a*, 1*b*, 1*c*, and 1*d* as image bearing members, charging rollers 2*a*, 2*b*, 2*c*, and 2*d*, drum cleaning blades 8*a*, 8*b*, 8*c*, and 8*d*, and waste toner containers, respectively.

The development units 4*a* to 1*d* include developing rollers 40*a*, 40*b*, 40*c*, and 40*d* and toner applying rollers 41*a*, 41*b*, 41*c*, and 41*d*, respectively. A scanner unit 3 is disposed above the process cartridges 7*a* to 7*d*. The scanner unit 3 performs exposure processing on photosensitive drums 1*a*, 1*b*, 1*c*, and 1*d* based on respective image signals. After the photosensitive drums 1*a*, 1*b*, 1*c*, and 1*d* are charged to a predetermined negative polarity potential by the charging rollers 2*a*, 2*b*, 2*c*, and 2*d*, electrostatic latent images formed on the photosensitive drums 1*a*, 1*b*, 1*c*, and 1*d* by the scanner unit 3, respectively. When these electrostatic latent images are subjected to reversal development by the development units 4*a*, 4*b*, 4*c*, and 4*d*, negative polarity toner is applied to the photosensitive drums 1*a*, 1*b*, 1*c*, and 1*d* to form Y, P, C, and Bk toner images, respectively.

In an intermediate transfer belt unit 112, an intermediate transfer belt 112*e* is stretched around a driving roller 112*f*, a secondary transfer counter roller 112*g*, and a tension roller 112*h*. A tension is applied in the direction of the arrow B by the tension roller 112*h*. Primary transfer rollers 112*a*, 112*b*, 112*c*, and 112*d* are disposed on the inner side of the intermediate transfer belt 112*e* to face the photosensitive drums 1*a*, 1*b*, 1*c*, and 1*d*, respectively. A transfer bias is applied to the primary transfer rollers 112*a*, 112*b*, 112*c*, and 112*d* by a bias application unit (not illustrated).

When the photosensitive drums 1*a* to 1*d* rotate in the direction of the arrows, the intermediate transfer belt 112*e* rotates in the direction of the arrow A, and a positive polarity bias is applied to the primary transfer rollers 112*a* to 112*d*, respectively. Thus, the toner images formed on the photosensitive drums as to 1*d* are primarily transferred onto the intermediate transfer belt 112*e* sequentially from the toner image on the photosensitive drum 1*a*. Then, the intermediate transfer belt 112*e* with toner images of four colors transferred thereon to be overlapped is conveyed to a secondary transfer portion 115.

A sheet feeding apparatus 113 is provided at the lower portion in the apparatus main body 100*a*. The sheet feeding apparatus 113 includes a sheet supplying cassette 111 detachably attached to the apparatus main body 100*a*, a feeding roller 9 for feeding a sheet P (transfer material such as paper) from the inside of the sheet supplying cassette 111, a conveyance roller 10, and a separation roller 14. The conveyance roller 10 conveys the sheet P fed by the feeding roller 9. The separation roller 14 is in pressure contact with the conveyance roller 10 from below, and the separation action by the separation roller 14 and the conveyance roller 10 separates the sheets P one by one. The sheet P conveyed from the sheet feeding apparatus 113 is conveyed to the secondary transfer portion 115 by a registration roller pair 117 disposed on the downstream side of the sheet conveyance direction.

At the secondary transfer portion 115, a positive polarity bias is applied to the secondary transfer roller 116 to secondarily transfer the 4-color toner image from the intermediate transfer belt 112*e* onto the conveyed sheet P. The sheet P with the toner image transferred thereon is conveyed to a fixing apparatus 114 and is heated and pressurized while being pinched between a fixing roller 96*a* and a pressure roller 96*b* of a fixing apparatus 96. Then, the toner image is fixed onto the front surface of the sheet P. The sheet P with the toner image fixed thereon passes through a sheet conveyance path 203 in the sheet conveyance apparatus 154. Being guided by a suitably switched guide member 181 (described below), the sheet P is sent to a discharge roller pair 120 via a sheet discharge conveyance path 201. Then, the sheet P is discharged onto a discharge tray 121 by the discharge roller pair 120.

Figure 3:
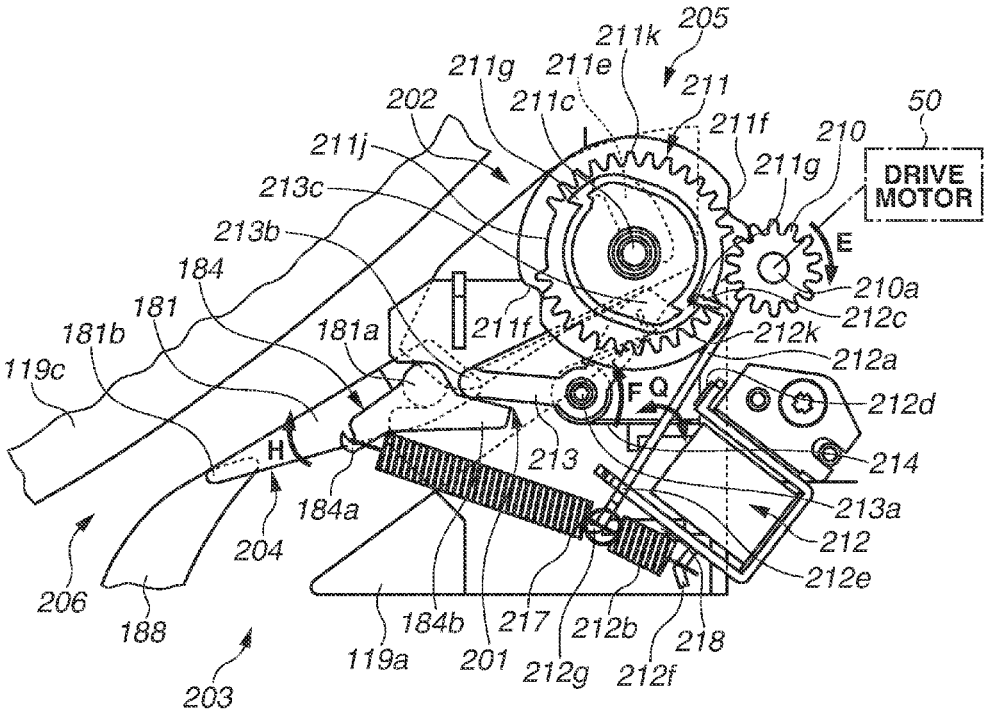
FIG. 3 is a section diagram illustrating a sheet discharge position of the switching apparatus according to the first exemplary embodiment.

The sheet conveyance apparatus 154 illustrated in FIG. 3 includes the sheet conveyance path 203, the sheet discharge conveyance path (first conveyance path) 201, a sheet reversing conveyance path (second conveyance path) 202, the guide member 181, and a tension spring (second urging member) 217 for urging the guide member 181 toward the second position. The sheet conveyance apparatus 154 further includes a partially toothless gear unit 211, a drive input gear 210, a cam 211*e*, a link member 213 (holding member), and a torsion coil spring 214 (first urging member).

In the case of two-sided printing, the following operations are performed in the apparatus main body 100*a*. The sheet P with an image fixed thereon by the fixing apparatus 114 is guided to the sheet reversing conveyance path (second conveyance path) 202 by the guide member 181 rotated (swung) in the clockwise direction. Then, the conveyance direction of the sheet P is reversed by a reversing roller pair 180. After the sheet P is reversed in the conveyance direction and then conveyed in a two-sided conveyance path 206 by the reversing roller pair 180, the sheet P is further conveyed by a two-sided conveyance roller pair 189 to the secondary transfer portion 115 and the fixing apparatus 114 again. After a toner image is fixed onto the back surface of the sheet P, the sheet P is discharged onto the discharge tray 121. The sheet conveyance path 203, the sheet discharge conveyance path 201, the sheet reversing conveyance path 202, and the two-sided conveyance path 206 are formed of guide portions 119*a*, 119*b*, and 119*c* formed of housing frames provided in the apparatus main body 100*a*, and a guide portion 188. The image forming unit 44, the secondary transfer portion 115, and the fixing apparatus 114 forms an image forming unit for forming an image on the sheet P conveyed by the sheet conveyance apparatus 154.

<Basic Configuration of Switch in Apparatus>

Figure 2:
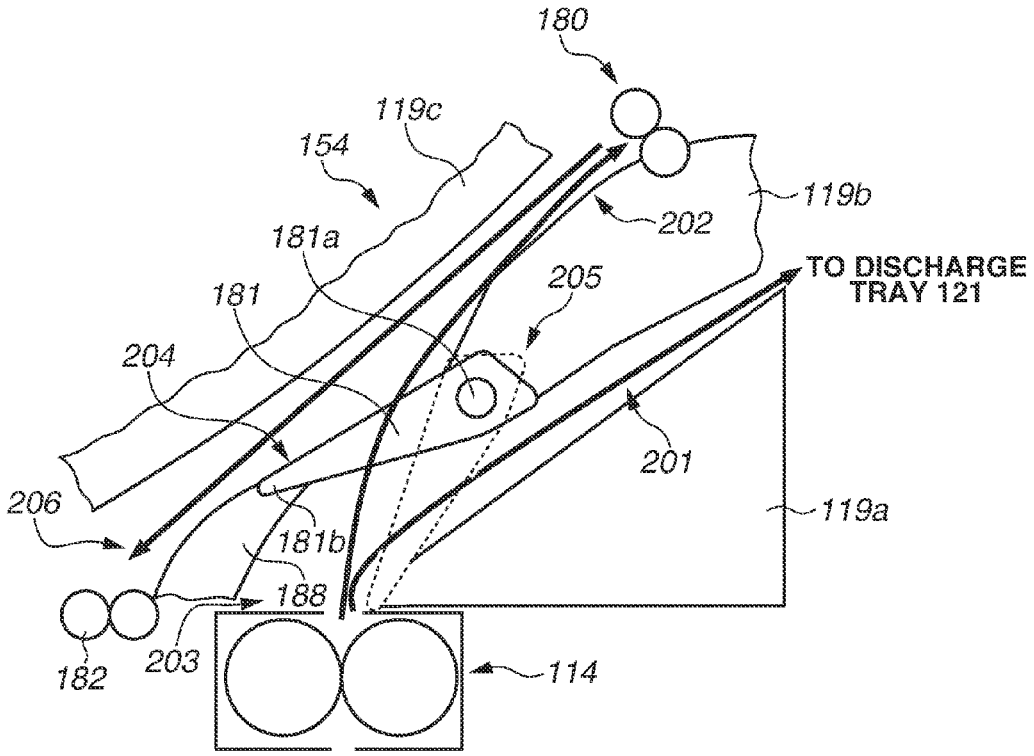
FIG. 2 is a schematic diagram illustrating an arrangement of a switching apparatus in the image forming apparatus illustrated in FIG. 1, viewed from the back side.

Next, the basic configuration of the switching apparatus 205 according to the present exemplary embodiment will be described below with reference to FIG. 2. FIG. 2 is a schematic diagram illustrating the guide member 181 and the structure in its vicinity in the image forming apparatus 100 illustrated in FIG. 1, viewed from the back side of the image forming apparatus 100 in FIG. 1.

As illustrated in FIG. 2, the sheet conveyance apparatus 154 includes the sheet discharge conveyance path (first, conveyance path) 201 and the sheet reversing conveyance path (second conveyance path) 202 extended to branch in at least two directions from the sheet conveyance path 203. In the vicinity of a branch point 204 between the sheet discharge conveyance path 201 and the sheet reversing conveyance path 202, the guide member 181 is supported so as to rotate (swing) in the clockwise and the counterclockwise directions illustrated in FIG. 2 taking a pivot axis 181*a* as a fulcrum. The pivot axis 181*a* is supported by the guide portion 119*b* formed of a housing frame.

The guide member 181 is configured to be movable between two different positions to switch the conveyance course of the sheet P conveyed from the sheet conveyance path 203. The first position (drawn by the solid lines in FIG. 2) is for switching the conveyance course of the sheet. P to the sheet discharge conveyance path 201, and the second position (drawn by broken lines in FIG. 2) is for switching the conveyance course thereof to the sheet reversing conveyance path 202. When the guide member 181 is switched to the solid line position through the clockwise rotation operation, the guide member 181 guides the sheet P with a toner image fixed thereon by the fixing apparatus 114 from the sheet conveyance path 203 to the sheet discharge conveyance path 201 to discharge the sheet P onto the discharge tray 121 (refer to FIG. 1).

When the guide member 181 is switched to the broken line position through the counterclockwise rotation operation, the guide member 181 guides the sheet P with a toner image fixed thereon from the sheet conveyance path 203 to the sheet reversing conveyance path 202. At this timing, the sheet P guided to the sheet reversing conveyance path 202 is then pinched and guided by the reversing roller pair 180. Then, after the trailing edge of the sheet P passes through the branch point 204, the reversing roller pair 180 reverses the rotational direction and then conveys the sheet P in the two-sided conveyance path 206 in the reverse direction, i.e., the trailing edge of the sheet P becomes the leading edge. Then, the sheet P is conveyed again to the secondary transfer portion 115 via a two-sided conveyance path 183 by the two-sided conveyance roller pair 189 and then is subjected to image forming processing on the back surface.

<Detailed Configuration of Switching Apparatus>

Next, the configuration of the switching apparatus 205 for switching the guide member 181 will be described in detail below with reference to FIGS. 3, 4A, 4B, 5A, and 5B.

As illustrated in FIG. 3, the switching apparatus 205 includes the guide member the partially toothless gear unit 211, and the drive input gear 210 rotating in one direction of the arrow E to enable transmitting the rotation to the partially toothless gear unit 211. The switching apparatus 205 further includes a solenoid unit 212 including an arm member 212*a* as an actuator, and the link member 213 for transmitting the rotation of the partially toothless gear unit 211 to the guide member 181. The link member 213 serves as a holding member for holding the guide member 181 at the first position. The switching apparatus 205 further includes a tension spring 217 for urging the guide member 181 to the second position, and the torsion coil spring 214. The tension spring 217 applies to the guide member 181 an urging force for moving the guide member 181 from the first to the second position. The torsion coil spring 214 applies to the link member 213 an urging force for holding the guide member 181 at the first position.

The partially toothless gear unit 211 and the drive input gear 210 form a rotary member which rotates by a predetermined angle (predetermined amount) in one direction each time a trigger is generated by the solenoid unit 212. The cam 211*e*, the link member 213, and the torsion coil spring 214 form a switching unit. Each time the rotary member formed of the partially toothless gear unit 211 and the drive input gear 210 rotates by the predetermined angle by the trigger, this switching unit moves the guide member 181 to the first position and holds the guide member 181 against the tension spring 217. When the switching unit further releases this holding condition, the guide member 181 is moved to the second position by the tension spring 217. The link member (interlocking lever) 213 has one end 213*c* which can be pressed by the cam (pressing portion) 211*e*, and the other end 213*b* for pressing the guide member 181 to move the guide member 181 to the first position.

Further, the solenoid unit 212 forms a trigger unit for generating a trigger (trigger signal). The solenoid unit 212 as a trigger unit has the above-described arm member 212*a* which moves each time a trigger (trigger signal) is generated. Then, the solenoid unit 212 drives the arm member 212*a* to move the arm member 212*a* to two different positions. At one position, the arm member 212*a* latches a first partially toothless gear 211*a* at a latching portion 212*c* to restrict the rotation of both the first partially toothless gear 211*a* and a second partially toothless gear 211*b*. At the other position, the arm member 212*a* does not latch them.

Figure 6A:
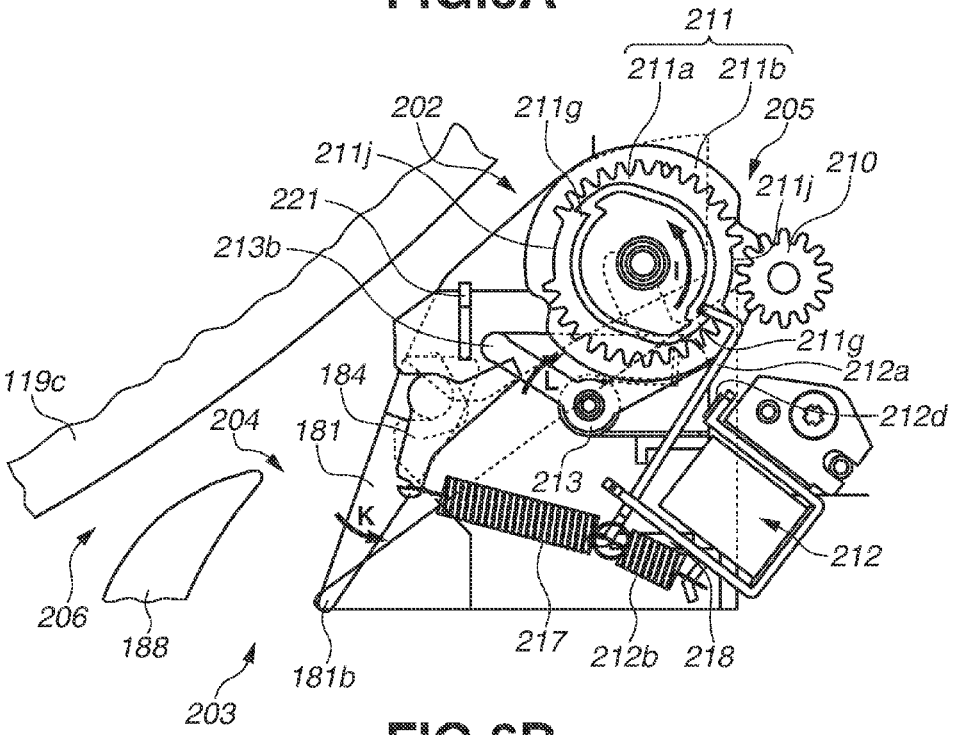
FIG. 6A is a section diagram illustrating a two-sided position of the switching apparatus according to the first exemplary embodiment.
Figure 6B:
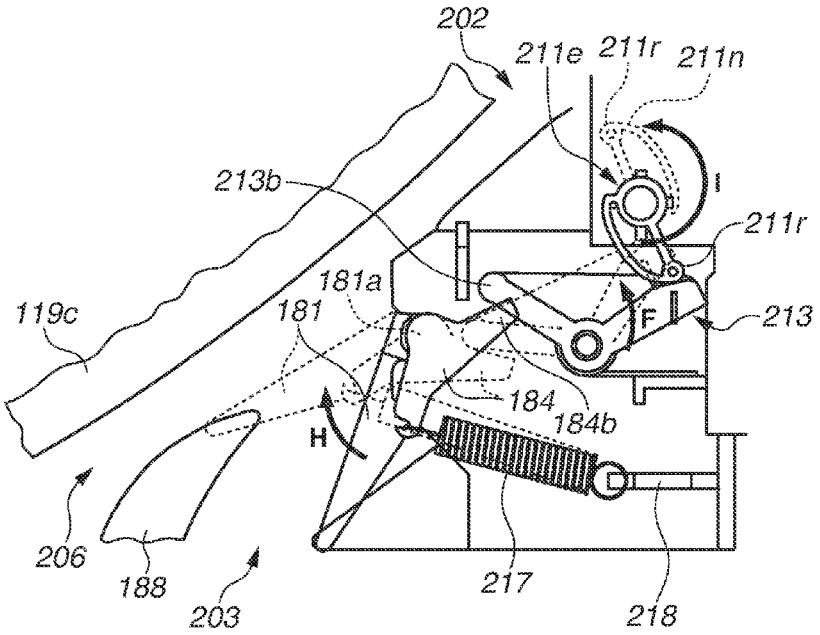
FIG. 6B is a section diagram illustrating an operation trajectory of each part, where the partially toothless gear unit is not illustrated.

A leading end 181*b* of the guide member 181 directed toward the sheet conveyance path 203 is overlapped with the guide portion 188 in the side view to be switched to the first position (the position drawn by broken lines in FIG. 6B). The leading end 181*b* of the guide member 181 is overlapped with the lower part of the guide portion 119*a* in the side view to be switched to the second position (the position drawn by the solid lines in FIG. 6B). The guide member 181 has a driven member 184 fixed to the guide member 181 to rotate together with the guide member 181 centering on the pivot axis 181*a* as a common pivot axis. The driven member 184 has a latched portion 184*a* and a force receiving portion 184*b*. One end of the tension spring (urging member) 217 is latched to a supporting member 218 provided on the side of the apparatus main body 100*a*, and the other end thereof is latched to the latched portion 184*a*. The other end 213*b* of the link member 213 is in sliding contact with the force receiving portion 184*b*. Therefore, the guide member 181 is urged to the second position by the tension spring 217 the other end of which is latched to the latched portion 184*a*.

Figure 4A:
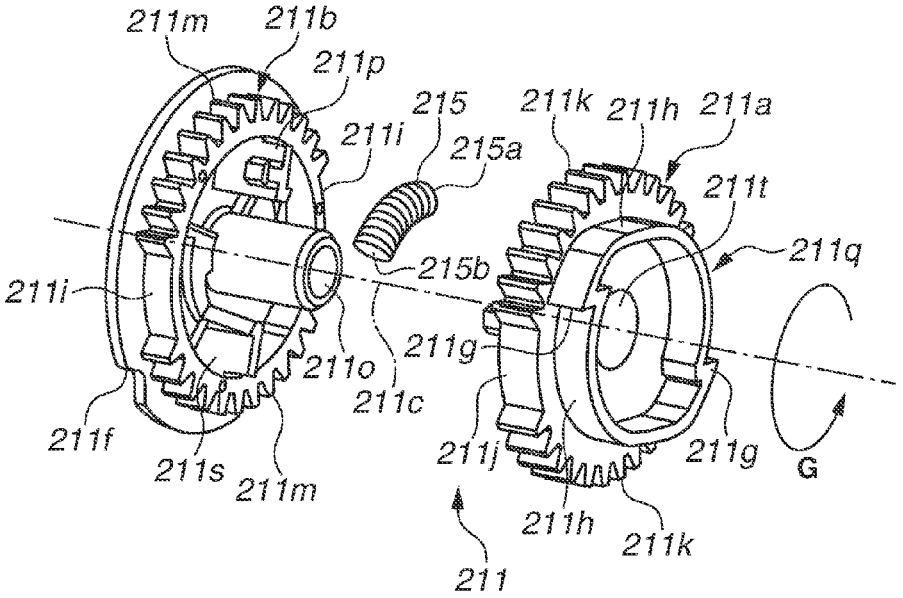
FIG. 4A is an exploded enlarged diagram illustrating a partially toothless gear unit according to the first exemplary embodiment.
Figure 4B:
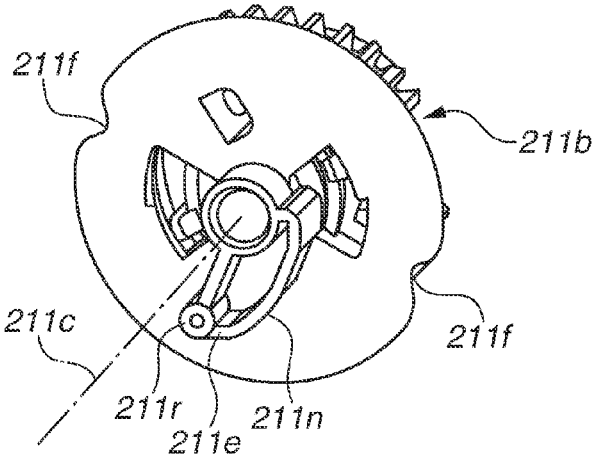
FIG. 4B is a perspective diagram illustrating a cam provided on a partially toothless gear.

As illustrated in FIGS. 3, 4A, and 4B, the partially toothless gear unit 211 is disposed obliquely above the guide member 181. The partially toothless gear unit 211 includes the first partially toothless gear 211*a* and the second partially toothless gear 211*b* connected with each other in a rotatably overlapped manner in a predetermined phase at a predetermined angle centering on a common pivot axis 211*c*.

The first partially toothless gear 211*a* has an axis bore 211*t* at the central portion, and tooth portions 211*k* formed at two different circumferential positions facing each other with respect to the axis bore 211*t*. Two toothless portions 211*j* (refer to FIGS. 6A and 6B) are respectively formed at two facing positions between the tooth portions 211*k*. An annular rib 211*q* formed in a predetermined locus centering on the axis bore 211*t* is fixed to the front surface of the first partially toothless gear 211*a* facing the opposite side of the second partially toothless gear 211*b*. The annular rib 211*q* is integrally formed with the first partially toothless gear 211*a*. Latched portions 211*g* to be latched by the latching portion. 212*c* of the arm member 212*a* are formed at intervals of a predetermined angle (at intervals of 180 degrees according to the present exemplary embodiment). Sliding-contact surfaces 211*h* to be in sliding contact with the latching portion 212*c* are provided between the latched portions 211*g*. The annular rib 211*q* is provided with the sliding-contact surfaces 211*h* at positions respectively corresponding to the tooth portions 211*k*, and also provided with the latched portions 211*g* at positions respectively corresponding to the toothless portions 211*j*. Each time the first partially toothless gear 211*a* rotates by 180 degrees, the upper and lower positions of the first partially toothless gears 211*a* interchange to be in the same phase.

On the other hand, the second partially toothless gear 211*b* has a boss with an axis hole 2110 formed at the central portion thereof, and tooth portions 211*m* are formed at two circumferential positions facing each other with respect to the axis hole 211*o*. On the second partially toothless gear 211*b*, two toothless portions 211*i* are respectively formed at two facing positions between the tooth portions 211*m*. The second partially toothless gear 211*b* has a supporting member 211*p* positioned on a surface facing the first partially toothless gear 211*a*, between the axis hole 211*o* and the tooth portion 211*m*. The supporting member 211*o* is in contact with one end 215*a* of the compression spring 215 to support the compression spring 215. The back surface of the first partially toothless gear 211*a* facing the second partially toothless gear 211*b* is provided with a supporting member (not illustrated) facing the supporting member 211*p*. This supporting member is in contact with the other end 215*b* of the compression spring 215 to support the compression spring 215. A regulating projection 211*s* is formed at the position circumferentially separated by 180 degrees from the supporting member 211*p* of the second partially toothless gear 211*b*. When a portion (not illustrated) of the first partially toothless gear 211*a* is latched to the regulating projection 211*s* at a predetermined rotational angle, the first partially toothless gear 211*a* is regulated not to rotate in the rotational direction by a predetermined angle or more, relative to the second partially toothless gear 211*b*.

As illustrated in FIG. 4B, the back surface of the second partially toothless gear 211*b* is provided with the integrally formed cam 211*e* having a predetermined shape. The cam 211*e* includes a curved portion 211*n* which radially extends with respect to the pivot axis 211*c*, and a sliding-contact portion 211*r* formed at an end of the curved portion 211*n*. Thus, the cam 211*e* is a projection-shaped member provided on the back surface of the second partially toothless gear 211*b*, having a predetermined cam profile including the sliding-contact portion 211*r* and the curved portion 211*n* which curves toward the sliding-contact portion 211*r*. The cam 211*e* forms a pressing portion which rotates together with the second partially toothless gear 211*b* to switch the guide member 181 to the first or the second position each time the first partially toothless gear 211*a* is unlatched.

The partially toothless gear unit 211 has two latched portions 211*g* to be latched by the hook-like latching portion 212*c* at the leading end of the arm member 212*a* in the solenoid unit 212 of a type using the guide member 181. The flange portion of the second partially toothless gear 211*b* is provided with a pair of depressed portions 211*f* facing each other at 180-degree different positions.

More specifically, the first partially toothless gear 211*a* and the second partially toothless gear 211*b* rotatably overlapped a predetermined phase are configured as follows. Specifically, the partially toothless gear unit 211 has the tooth portions 211*k* and the tooth portions 211*m* and the toothless portions 211*j* and the toothless portions 211*i* at circumferential positions respectively facing each other so that a force for switching the guide member 181 in one direction and the other direction is generated each time the partially toothless gear unit 211 rotates by 180 degrees in the direction of the arrow G illustrated in FIG. 4A. The compression spring 215 provided in a compressed manner between the first partially toothless gear 211*a* and the second partially toothless gear 211*b* generates a force for rotating the first partially toothless gear 211*a* in the direction of the arrow G relative to the second partially toothless gear 211*b*.

As described above, the first partially toothless gear 211*a* and the second partially toothless gear 211*b* include, at respective circumferential positions, a plurality of tooth portions 211*k* and 211*m* which can be engaged with the drive input gear 210 and a plurality of toothless portions 211*j* and 211*i* which cannot be engaged with the input gear 210. In a state where both the partially toothless gears 211*a* and 211*b* are subjected to rotation regulation and both the toothless portions 211*j* and 211*i* are axially aligned with each other (in the direction of the pivot axis 211*c*) facing the drive input gear 210, when rotation regulation of the first partially toothless gear 211*a* is released by the above-described trigger, the following operation is performed. More specifically, the first partially toothless gear 211*a* rotates relative to the second partially toothless gear 211*b* and, when the first partially toothless gear 211*a* is engaged with the drive input gear 210, the first partially toothless gear 211*a* rotates together with the second partially toothless gear 211*b*.

As illustrated in FIG. 3, the apparatus main body 100*a* (refer to FIG. 1) includes a drive motor 50 and the drive input gear 210 rotatably disposed adjacent to the partially toothless gear unit 211. The drive input gear 210 is supported rotatably around a pivot axis 210*a* which is supported so as to extend in parallel with the pivot axis 211*c* of the partially toothless gear unit 211. When the drive motor 50 is rotatably driven under control of the control unit 118, the drive input gear 210 is rotated in the direction of the arrow F.

The link member 213 supported rotatably around a pivot axis 213*a* is disposed below the partially toothless gear unit 211. The other end 213*b* of the link member 213 contacts the guide member 181, and the one end 213*c* thereof contacts the cam 211*e* of the partially toothless gear unit 211 at intervals of one rotation. The link member 213 is constantly urged in the direction of the arrow F by the torsion coil spring 211, which is a torsion spring provided around the pivot axis 213*a*.

The torsion coil spring 214 as a strong urging member is set to have a stronger urging force (spring force) than the urging force by the tension spring 217 of the guide member 181. More specifically, the torsion coil spring 214 is configured to apply a stronger urging force than the urging force of the tension spring 217 to the link member (interlocking lever) 213 to enable moving the guide member 181 to the first position against the tension spring (urging member) 217. When the partially toothless gear unit 211 is at the position illustrated in FIG. 3, the torsion coil spring 214 of the link member 213 is rotated in the direction of the arrow H against the urging force of the tension spring 217 and accordingly the guide member 181 is kept being upwardly swung.

The solenoid unit 212 disposed under the partially toothless gear unit 211 and the drive input gear 210 includes a magnet type (flapper type) solenoid. The solenoid unit 212 is activated so as to attract the arm member 212*a*, i.e., a movable iron piece (armature) rotatably supported by a frame hinge (rotational center) 212*e*, by an attraction unit 212*d* when the iron core is magnetized by a supplied current. In the solenoid unit 212, hooking one end and the other end of a returning tension spring 212*b* on a claw portion 212*f* and a lower claw portion 212*g* of the arm member 212*a*, respectively, enables rotating the latching portion 212*c* at the leading end of the arm member 212*a* in the direction for contacting the partially toothless gear unit 211 and in the direction for separating therefrom. In this way, the magnet type solenoid unit 212 remarkably reduces cost compared with a plunger type solenoid. Therefore, although several mechanical parts such as the partially toothless gears 211*a* and 211*b* are additionally required, the present configuration is lower in cost than the conventional configuration.

Figure 5A:
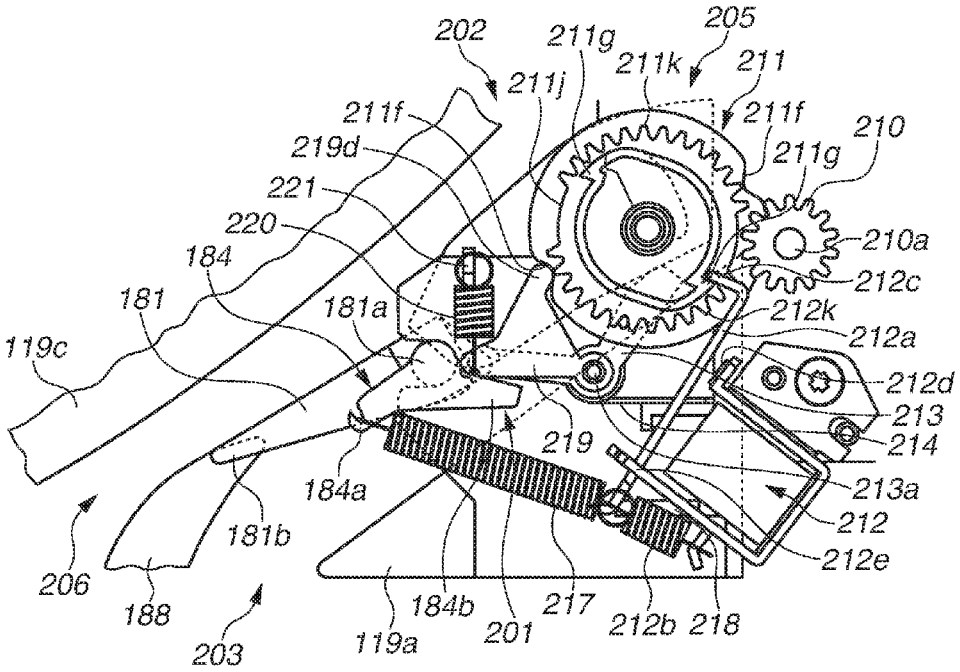
FIG. 5A is a section diagram illustrating the switching apparatus according to the first exemplary embodiment.

According to the present exemplary embodiment, as illustrated in FIG. 5A, a stopper member 219 is disposed to stop the rotation of the partially toothless gear unit 211 at a predetermined position. The stopper member 219 is supported so as to rotatably support a supporting boss unit 219*c* around the pivot axis 213*a* as a common pivot axis for the supporting boss unit 219*c* and the link member 213. When the upper end 219*d* of the stopper member 219 is latched to a depressed portion 211*f* formed on the flange portion of the second partially toothless gear 211*b* through the urging force of the stopper spring 220, the phases in which the partially toothless gear unit 211 rotates and stops are determined. The stopper spring 220 is a tension spring one end of which is latched to a supporting portion 221 provided on the side of the apparatus main body 100*a*, and the other end is latched to a lower end 219*e* of the stopper member 219. Of course, the configuration of the image forming apparatus 100 is not limited thereto, and other configuration is also applicable as long as the partially toothless gear unit 211 is stopped at a predetermined position.

<Description of Switching Apparatus Operations>

Next, operations of the switching apparatus 205 according to the present exemplary embodiment will be described below.

As illustrated in FIG. 3, in the switching apparatus 205 according to the present exemplary embodiment, when the one end 213*c* of the link member 213 is pressed by the cam 211*e*, the other end 213*b* thereof having pressed the guide member 181 is moved to release the guide member 181. Thus, the guide member 181 is switched to the second position by the tension spring 217 (refer to FIGS. 6A and 6B). Referring to FIGS. 6A and 6B, when the one end 213*c* of the link member 213 is released from the cam 211*e*, the other end 213*b* thereof is moved by the torsion coil spring 214 to press the guide member 181 to switch the guide member 181 to the first position against the tension spring 217.

More specifically, at the time of the above-described one-sided conveyance or in a state where the sheet P with two-sided printing completed is discharged onto the discharge tray 121 (sheet discharge position), the drive input gear 210 and the partially toothless gear unit 211 are not engaged with each other, as illustrated in FIG. 3. In this case, the drive force is not input to the partially toothless gear unit 211 regardless of the rotation operation of the drive input gear 210. The force of the torsion coil spring 214 via the link member 213 is designed to satisfy a certain force relation in this state, i.e., the force of the torsion coil spring 214 via the link member 213 overcomes the force of the tension spring 217 acting on the guide member 181 via the driven member 184. Therefore, the state where the guide member 181 rotates in the direction of the arrow H, as illustrated in FIG. 3, can be maintained by the rotary force by the link member 213.

Figure 5B:
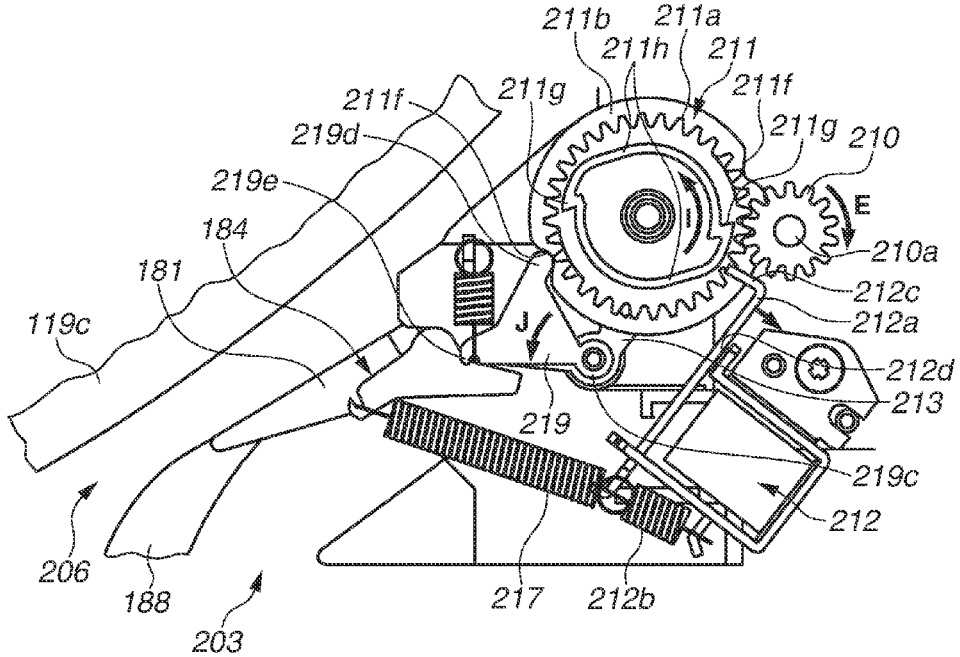
FIG. 5B is a section diagram illustrating a state immediately after a solenoid is turned ON in the state illustrated in FIG. 5A.

In the case of two-sided printing, when the leading edge of the sheet P with an image transferred and fixed onto the first surface is conveyed to a predetermined position, a current is supplied to the solenoid unit 212 by an instruction from the control unit 118 to turn ON the solenoid unit 212. More specifically, the arm member 212*a* in the state illustrated in FIG. 5A temporarily attracted by the solenoid unit 212 as illustrated in FIG. 5B. Accordingly, the arm member 212*a* rotates taking the frame hinge unit 212*e* as a fulcrum against the urging force of the tension spring 212*b* and is attracted by the attraction unit 212*d*. The latching portion 212*c* of the arm member 212*a* is unlatched from the latched portion 211*g* of the first partially toothless gear 211*a*.

In the partially toothless gear unit 211, the urging force of the compression spring 215 (refer to FIG. 4A) rotates the first partially toothless gear 211*a* in the direction of the arrow I with respect to the second partially toothless gear 211*b* which is prevented to rotate by the upper end 219*d* of the stopper member 219 engaged with the depressed portion 211*f*. Accordingly, the tooth portion 211*k* of the first partially toothless gear 211*a* is engaged with the drive input gear 210. At the time of two-sided printing, since the drive input gear 210 is constantly rotating in the direction of the arrow E under control of the control unit 118, the first partially toothless gear 211*a* rotates in the direction of the arrow I by the rotary force transmitted from the drive input gear 210.

The first partially toothless gear 211*a* is regulated not to rotate in the rotational direction exceeding a predetermined angle relative to the second partially toothless gear 211*b*. In other words, when the first partially toothless gear 211*a* rotates by the predetermined angle, the second partially toothless gear 211*b* also rotates in the direction of the arrow I together with the first partially toothless gear 211*a*. At this time, the rotational driving force of the second partially toothless gear 211*b* rotates the upper end 219*d* of the stopper member 219 having been engaged with the depressed portion 211*f* of the flange of the second partially toothless gear 211*b* in the direction of the arrow J illustrated in FIG. 5B. This action releases the regulation action on the second partially toothless gear 211*b* in the rotation direction.

Meanwhile, immediately after the solenoid unit 212 turns ON, the current supply (trigger supply) to the solenoid unit 212 is stopped under control of the control unit 118. Accordingly, the arm member 212*a* is urged to return to the original position illustrated in FIG. 5A by the traction of the solenoid spring 212*b*. At this timing, since the partially toothless gear unit 211 is rotating in the direction of the arrow I, the latching portion 212*c* of the arm member 212*a* is latched to the latched portion 211*g* of the annular rib 211*q* of the first partially toothless gear 211*a*. The partially toothless gear unit 211 rotates by 180 degrees while maintaining the state of the latching portion 212*c* in sliding contact with the annular rib 211*q* by the urging force by the solenoid spring 212*b*. Then, the latching portion 212*c* is latched to the other latched portion 211*g*, resulting in the state illustrated in FIG. 6A. FIG. 6A illustrates a state where the guide member 181 rotates to be downwardly swung to enable conveying the sheet P toward the sheet reversing conveyance path 202 (hereinbelow, this state is referred to as a "two-sided position").

Next, operations for shifting from the sheet discharge position (the position illustrated in FIG. 3 and the position drawn by broken lines illustrated in FIG. 6B) to the two-sided position (the position illustrated in FIG. 6A and the position drawn by the solid lines illustrated in FIG. 6B) will be described below with reference to FIG. 6B. FIG. 6B illustrates the same state as the state illustrated in FIG. 6A, where the gear portions of the first partially toothless gear 211*a* and the second partially toothless gear 211*b* are omitted.

Referring to FIG. 6B, the cam 211*e* corresponding to the two-sided position is drawn by the solid lines, and the cam 211*e* corresponding to the sheet discharge position is drawn by broken lines. Referring to FIG. 6B, the guide member 181, the driven member 184, and the link member 213 corresponding to the two-sided position are also drawn by the solid lines, and the guide member 181, the driven member 184, and the link member 213 corresponding to the sheet discharge position are drawn by broken lines.

Referring to FIG. 6B, when the partially toothless gear unit 211 accompanied by the cam 211*e* drawn by the solid lines rotates by 180 degrees in the direction of the arrow the link member 213 rotates in the direction of the arrow F in sliding contact with the sliding-contact portion 211*r* of the cam 211*e* and then shifts to the position drawn by broken lines. Accordingly, the other end 213*b* of the link member 213 contacts the force receiving portion 184*b* of the driven member 184. Then, interlocking with the rotation of the link member 213, the guide member 181 integrally formed with the driven member 184 rotates in the direction of the arrow H around the pivot axis 181*a*. Then, the sheet discharge position drawn by broken lines results.

This also applies to a case of shifting from the sheet discharge position (the position illustrated in FIG. 3 and the position drawn by the broken lines illustrated in FIG. 6B) to the two-sided position (the position drawn by the solid lines illustrated in FIG. 6B). More specifically, at the sheet discharge position drawn by the broken lines illustrated in FIG. 6B, the solenoid unit 212 turns ON under control of the control unit 118. When the latching portion 212*c* is unlatched from the latched portion 211*g* of the annular rib 211*q* of the first partially toothless gear 211*a*, the first partially toothless gear 211*a* rotates. Then, the cam 211*e* drawn by the broken lines rotates in the direction of the arrow I and contacts the link member 213 drawn by the broken lines to rotate the link member 213 in the direction opposite to the direction of the arrow F. Accordingly, when the force receiving portion 184*b* is released, the driven member 184 rotates in the direction opposite to the direction of the arrow H interlocking with the link member 213, resulting in the two-sided position drawn by the solid lines. Repeating the above-described operation enables quickly switching between the sheet discharge position and the two-sided position.

More specifically, when the cam 211*e* rotates at a predetermined angle, the link member 213 moves between the hold position (drawn by the broken lines illustrated in FIG. 6B) and the release position (drawn by the solid lines illustrated in FIG. 6B). At the hold position, the link member 213 urged by the torsion coil spring 214 holds the guide member 181 at the first position against the urging force of the tension spring 217. On the other hand, at the release position, the holding condition of the guide member 181 by the link member 213 is released, and the guide member 181 is held at the second position by the tension spring 217.

In order not to disturb the sheet P being conveyed in the sheet discharge conveyance path 201 and the sheet reversing conveyance path 202, the switching apparatus 205 according to the present exemplary embodiment is disposed at at least one end of the sheet conveyance paths (e.g., on the front side in the depth direction illustrated in FIG. 3). However, of course, the switching apparatus 205 may be disposed at the both ends of the sheet conveyance paths. This also applies to the second exemplary embodiment (described below).

<First Description of Relation Between Guide Member and Sheet>

Figure 7A:
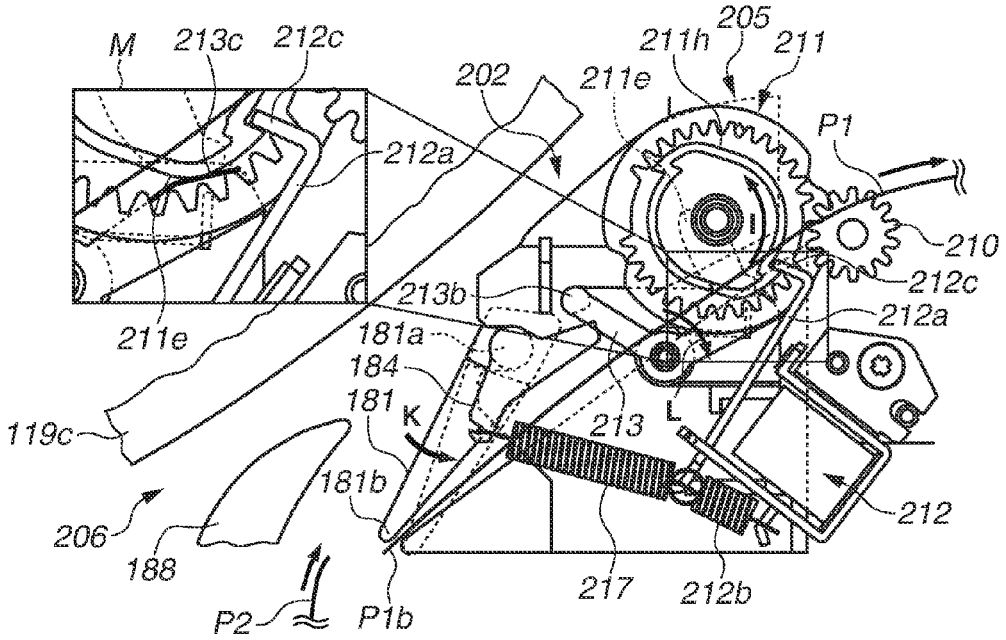
FIG. 7A is a section diagram illustrating a positional relationship between a guide member and a sheet conveyed to a sheet discharge conveyance path according to the first exemplary embodiment.

Next, a relationship between the guide member 181 and the sheet P will be described below with reference to FIG. 7A. FIG. 7A is a schematic diagram illustrating the positional relationship between the switching operation of the guide member 181 and a sheet P when a following sheet P2 is guided to the sheet reversing conveyance path 202 while a preceding sheet P1 is being conveyed in the sheet discharge conveyance path 201.

According to the present exemplary embodiment, to enable the guide member 181 to quickly distribute the sheets P continuously conveyed at short sheet intervals to the respective sheet conveyance paths, the guide member 181 is rotated while the preceding sheet P1 is being conveyed. More specifically, since the guide member 181 performs the rotation operation in the direction of the arrow K in a state where the guide member 181 is upwardly swung while the preceding sheet P1 is being conveyed in the sheet discharge conveyance path 201 (refer to FIGS. 5A and 5B), the leading end 181*b* of the guide member 181 contacts the preceding sheet P1. The guide member 181 maintains this state until the preceding sheet P1 passes the guide member 181. When a trailing edge P1*b* of the preceding sheet P1 passes the guide member 181, the guide member 181 rotates up to the position drawn by broken lines to enable immediately guiding the following sheet P2 toward the sheet reversing conveyance path 202.

According to the present exemplary embodiment, most of the rotation operation of the guide member 181 is completed when the preceding sheet P1 passes the guide member 181 compared with a case where the rotation operation of the guide member 181 is started after the trailing edge P1*b* of the preceding sheet P1 passes the guide member 181. Therefore, the following sheet P2 can be reliably guided to the sheet reversing conveyance path 202 even with a short sheet interval between the preceding sheet P1 and the following sheet P2. Further, the guide member 181 during switching is in sliding contact with the passing sheet P via a comparatively weak urging force by the tension spring 217 and the torsion coil spring 214, reducing the possibility that an image failure occurs.

In the state illustrated in FIG. 7A, the link member 213 is held at a fixed position by being pressed by the cam 211*e* of the partially toothless gear unit 211, the other end 213*b* and the guide member 181 separate from each other, and the guide member 181 is released. Therefore, the contact pressure of the guide member 181 onto the preceding sheet P1 is determined by the spring force of the tension spring 217 and the weight of the guide member 181 itself. Therefore, setting the spring pressure as low as possible enables reducing the possibility of an image failure even if the preceding sheet P1 is conveyed while the leading end 181*b* of the guide member 181 is in contact with the imaging range of the preceding sheet P1.

<Rotational Speed of Guide Member in Direction of Arrow K>

Next, the rotational speed of the guide member 181 rotating in the direction of the arrow K will be described below with reference to the enlarged diagram in the square area M illustrated in FIG. 7A.

As illustrated in the square area K illustrated in FIG. 7A, the resultant force of the spring force by the tension spring 217 and the weight of the guide member 181 itself is acting on the guide member 181 in the direction of the arrow K. The rotation of the guide member 181 is interlocked with the rotation operation of the link member 213 in the direction of the arrow L. The rotational speed of the guide member 181 can be arbitrarily set by devising the rotational speed of the partially toothless gear unit 211, the predetermined cam profile of the cam (pressing portion) 211*e*, and the shape of the one end 213*c* of the link member 213 in sliding contact with the cam 211*e*. For example, the predetermined cam profile of the cam 211*e* may be made into a gradual shape. When the leading end of the cam 211*e* rotating in the direction of the arrow I is separated from the one end 213*c* of the link member 213, the gradual shape allows the one end 213*c* rotating in the direction of the arrow F to be gradually separated from the cam 211*e* while in sliding contact with the cam 211*e*. This enables reducing the rotational speed of the guide member 181 at the timing of contacting the sheet P when switching the guide member 181 to the side of the sheet reversing conveyance path 202 during sheet conveyance in the sheet reversing conveyance path (second conveyance path) 202. Accordingly, it becomes possible to reduce paper contact sound occurring when the guide member 181 contacts the sheet P. Further, suitably setting the shape of the one end 213*c* of the link member 213 according to the cam profile of the cam 211*e* enables further enhancing the effect of reducing paper contact sound occurring when the guide member 181 contacts the sheet P.

<Second Description of Relation Between Guide Member and Sheet>

Figure 7B:
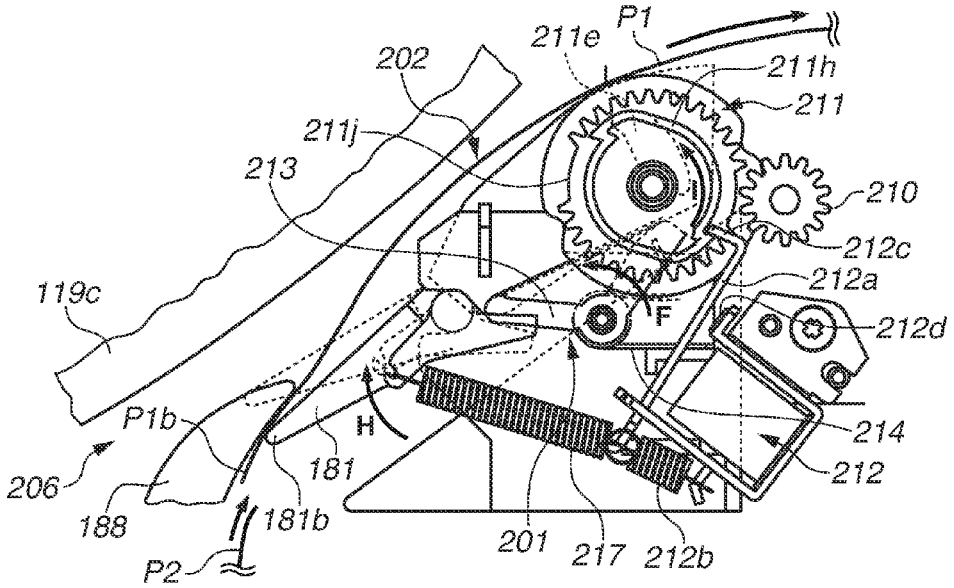
FIG. 7B is a section diagram illustrating a positional relationship between the guide member and a sheet reversing conveyance path according to the first exemplary embodiment.

Next, the relationship between the guide member 181 and the sheet P will be described below with reference to FIG. 7B. FIG. 7B is a schematic diagram illustrating the positional relationship between the switching operation of the guide member 181 and the sheet P when guiding the following sheet P2 to the sheet discharge conveyance path 201 while the preceding sheet P1 is being conveyed in the sheet reversing conveyance path 202.

More specifically, as illustrated in FIG. 7B, the guide member 181 performs the rotation operation in the direction of the arrow H while the preceding sheet P1 is being conveyed in the sheet reversing conveyance path 202. The guide member 181 is rotated until the leading end 181*b* contacts the preceding sheet P1. The guide member 181 maintains this state until the preceding sheet P1 passes the guide member 181. At the moment the trailing edge P1*b* of the preceding sheet P1 has passed the guide member 181, the guide member 18 rotates up to the position drawn by the broken lines. Accordingly, the leading end 181*b* is stored in the facing guide portion to reliably guide the following sheet P2 toward the sheet discharge conveyance path 201.

According to the present exemplary embodiment, most of the rotation operation completed when the preceding sheet P1 has passed the guide member 181 also in the operation for upwardly swinging the guide member 181 illustrated in FIG. 7B, similar to the operation for downwardly swinging the guide member 181 illustrated in FIG. 7A. Therefore, even with a short sheet interval, the following sheet P2 can be reliably guided toward the sheet discharge conveyance path 201.

In the state illustrated in FIG. 7B, the contact pressure between the guide member 181 and the preceding sheet P1 is determined by the spring force of the torsion coil spring 214 in the direction of the arrow F via the link member 213, the spring force of the tension spring 217, and the weight of the guide member 181 itself. Therefore, setting the spring pressure as low as possible enables reducing the possibility of an image failure even if the preceding sheet P1 is conveyed while the leading end 181*b* of the guide member 181 is in contact with the imaging range of the preceding sheet P1.

<Rotational Speed of Guide Member in Direction of Arrow H>

Next, the rotational speed at which the guide member 181 rotates in the direction of the arrow H will be described below with reference to FIG. 7C.

Figure 7C:
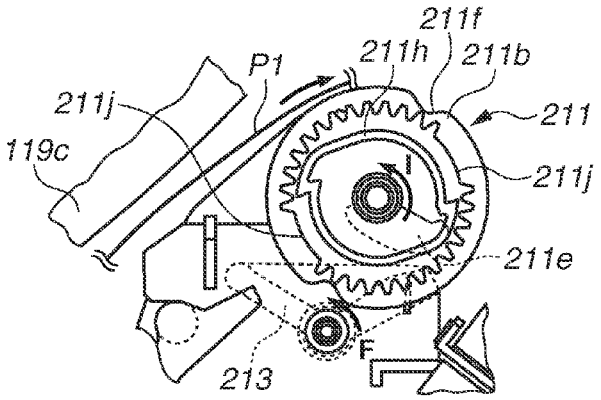
FIG. 7C is an expanded section diagram illustrating operations of the cam of a partially toothless gear and a link member according to the first exemplary embodiment.

Referring to FIG. 7C, the cam 211*e* of the second partially toothless gear 211*b* and the link member 213 drawn by the broken lines indicate a state where the guide member 181 contacts the preceding sheet P1. More specifically, interlocking with the partially toothless gear unit 211 rotating in the direction of the arrow I, the link member 213 contacts the cam 211*e* to be rotated in the direction of the arrow F. The rotational speeds of the link member 213 and the guide member 181 interlocking with the link member 213 can be arbitrarily set by devising the rotational speed of the second partially toothless gear 211*b* and the cam profile of the cam 211*e* of the second partially toothless gear 211*b*. Therefore, for example, reducing the rotational speed of the guide member 181 at the timing of contacting the sheet P enables further reducing abnormal sound occurring when the guide member 181 contacts the sheet P.

According to the above-described exemplary embodiments, it is possible to provide a new drive configuration or the guide member 181 for switching the conveyance course of sheets conveyed at short sheet intervals to the respective predetermined sheet conveyance paths. As for image failures, the rotations of the guide member 181 in both directions are produced by using springs (the tension spring 217 and the torsion coil spring 214). The pressure at which the guide member 181 presses the sheet P can be correctly managed by the spring pressures. This enables reducing image failures.

According to the present exemplary embodiment, the required spring pressures and the rotational angle of the guide member 181 are separately set by using the driving forces of the solenoid unit 212 and the partially toothless gear unit 211 instead of a plunger type solenoid. This enables comparatively arbitrarily setting each condition.

As for paper contact sound, the cam 211*e* provided on the partially toothless gear unit 211 is made to contact the link member 213 as described above. Thus, the rotational speed of the guide member 181 rotating interlocking with the link member 213 can be arbitrarily set according to the cam profile. For example, the cam profile is designed so that the rotational speed of the guide unit 181 is increased within a range where the guide member 181 is not in contact with a conveyed sheet and the rotational speed thereof is reduced within a range where the guide member 181 is in contact with a conveyed sheet. Thus, sheet contact sound can be reduced compared with the electric current control like a plunger type solenoid.

As for cost, the solenoid unit 212 of the type according to the present exemplary embodiment is remarkably lower in cost than a plunger type solenoid. Although, in this case, the present configuration requires several additional mechanical parts of the partially toothless gear unit 211, the present configuration is lower in cost than the conventional configuration.

As for temperature rise, electric current is supplied to the solenoid unit 212 of the guide member type only at the moment when the arm member 212*a* is attracted. Therefore, compared with the configuration in which electric current constantly supplied during sheet conveyance as with a plunger type solenoid, the time period during which electric current is supplied to the solenoid unit 212 remarkably decreases, thus reducing self-temperature rise in the solenoid unit 212.

According to the present exemplary embodiment, it becomes possible to implement a new drive configuration for switching the conveyance course of sheets conveyed at short sheet intervals to the respective predetermined sheet conveyance paths while restricting power consumption without using a plunger type solenoid.

In the present exemplary embodiment, a guide member configuration including the two toothless portions 211*j* of the first partially toothless gear 211*a*, the two toothless portions 211*i* of the second partially toothless gear 211*b*, and the two standby positions, is described. However, the configuration of the present exemplary embodiment is not limited thereto. For example, it is possible to provide at least three toothless portions to each of the partially toothless gears to enable multi-stage switching of the guide member 181. In this case, the guide member 181 is able to stand by at three or more positions (conventionally two positions) making it possible to extend the design flexibility in the shapes of the guide member 181 and the sheet conveyance paths.

In the present exemplary embodiment, an example configuration is described in which the guide member 181 is disposed at the branching portion between the sheet discharge conveyance path 201 and the sheet reversing conveyance path 202. However, of course, the present configuration is not limited to such the guide member 181, and applicable to all guide members for the sheet conveyance paths that form a branching portion.

Figure 8A:
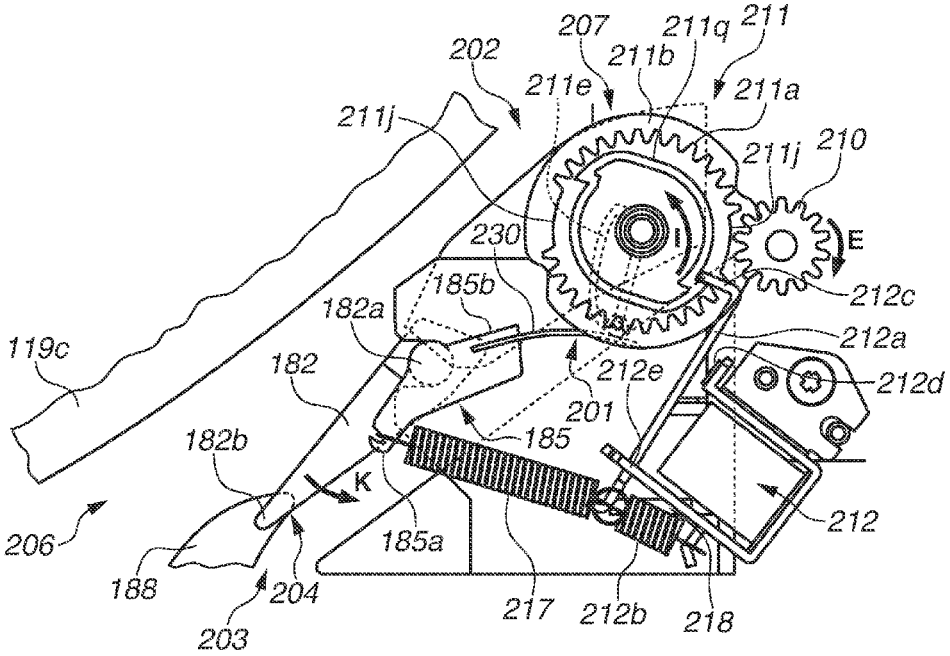
FIG. 8A is a section diagram illustrating a sheet discharge position of a switching apparatus according to a second exemplary embodiment.
Figure 8B:
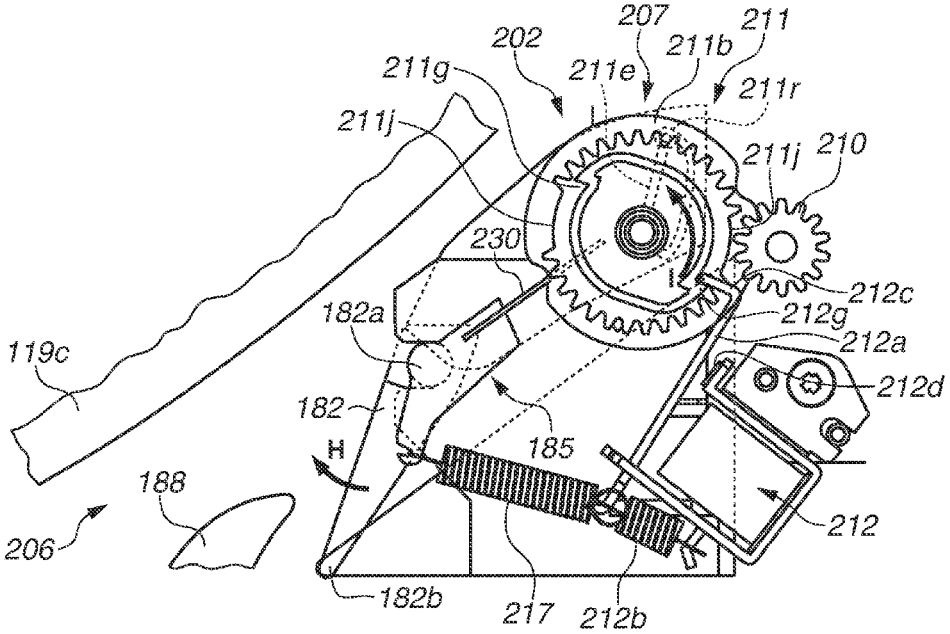
FIG. 8B is a section diagram illustrating a two-sided position of the switching apparatus according to the second exemplary embodiment.

Next, a second exemplary embodiment will be described below with reference to FIGS. 8A and 8B. FIG. 8A is a section diagram illustrating the sheet discharge position of a switching apparatus 207 according to the present exemplary embodiment, and FIG. 8B is a section diagram illustrating the two-sided position of the switching apparatus 207. In the present exemplary embodiment, members identical to those according to the first exemplary embodiment are assigned the same reference numerals, and detailed descriptions of members having the same configurations and functions will be omitted. Even with different reference numerals, such members are assigned the same member names and descriptions thereof may be omitted.

<Description of Basic Configuration of Switching Apparatus>

As illustrated in FIG. 8A, the configurations and operation methods of the solenoid unit 212, the partially toothless gear unit 211, and the drive input gear 210 are similar to those according to the first exemplary embodiment. The present exemplary embodiment characterized in that a leaf spring 230 as an elastic member is integrally fixed to the side of a guide member 182 close to the cam (pressing portion) 211*e*.

The guide member 182 includes a driven member 185 fixed so as to rotate together with the guide member 182 taking the pivot axis 182*a* as a common pivot axis. The driven member 185 includes a latched portion 185*a* and a force receiving portion 185*b*. One end of the tension spring 217 is latched to the supporting member 218 provided on the side of the apparatus main body 100*a*, and the other end thereof is latched to the latched portion 185*a*. One end of the leaf spring 230 is fixed to the force receiving portion 185*b*.

One end of the leaf spring 230 is integrally supported by the guide member 182 via the driven member 185, and the other end thereof is protruded to the side of the partially toothless gear unit 211 so as to be in contact with the rotating cam 211*e*. The leaf spring 230 is configured to be bent by elasticity when pressed by the cam 211*e* at intervals of one rotation. The bending of the leaf spring 230 reduces the contact pressure produced when the guide member 182 contacts the sheet P being conveyed to the sheet reversing conveyance path 202.

The switching unit according to the present exemplary embodiment is provided with the cam (pressing portion) 211*e* disposed on the second partially toothless gear 211*b*. Each time the first partially toothless gear 211*a* is unlatched, the cam 211*e* rotates together with the second partially toothless gear 211*b* to switch the guide member 182 to either the first or the second position. When the leaf spring (elastic member) 230 is pressed by the cam (pressing portion) 211*e*, the leaf spring 230 bends by its elastic force to switch the guide member 182 to the first position against the urging force of the spring (urging member) 217. When the leaf spring 230 is released from the cam 211*e*, the leaf spring 230 releases the guide member 182 to switch the guide member 182 to the second position according to urging force of the tension spring 217.

<Description of Operations of Switching Apparatus>

FIG. 8A illustrates the sheet discharge position for guiding the normal sheet P to the discharge tray 121. As illustrated in FIG. 8A, the solenoid unit 212 turns ON in a state where the drive input gear 210 is rotating in the direction of the arrow E by the drive motor 50 (refer to FIG. 3) driven under control of the control unit 118 (refer to FIG. 1). Accordingly, based on a similar method to the method according to the first exemplary embodiment, the partially toothless gear unit 211 is engaged with the drive input gear 210 and rotates in the direction of the arrow I.

When the partially toothless gear unit 211 rotates, the leaf spring 230 relatively bends along (in sliding contact with) the cam profile of the cam 211*e* on the back surface of the second partially toothless gear 211*b*. When the partially toothless gear unit 211 rotates by a predetermined angle or more, the cam 211*e* starts releasing the leaf spring 230 to reduce the bending force of the leaf spring 230. Accordingly, the guide member 182 starts rotating in the direction of the arrow K by the spring force of the tension spring 217.

When the partially toothless gear unit 211 rotates more than a certain predetermined angle, the cam. 211*e* separates from the leaf spring 230. Accordingly, the guide member 182 rotates in the direction of the arrow K by the spring force of the tension spring 217 and the weight of the guide member 182 itself. Then, the two-sided position for guiding the sheet P toward the sheet reversing conveyance path 202 results, as illustrated in FIG. 8B. At this timing, the latching portion 212*c* of the arm member 212*a* is latched to the latched portion 211*g* while in sliding contact with the sliding-contact surface 211*h* of the annular rib 211*g*. Therefore, when the rotation of the first partially toothless gear 211*a* is stopped, the second partially toothless gear 211*b* stops accordingly.

When the solenoid unit 212 turns ON again, the arm member 212*a* rotates in the clockwise direction illustrated in FIG. 8B taking the frame hinge 212*e* as a fulcrum (rotational center), and the latching portion 212*c* unlatches one of the latched portions 211*g*. Accordingly, the first partially toothless gear 211*a* rotates relative to the second partially toothless gear 211*b* by the spring force of the compression spring 215. As a result, the partially toothless gear units 211 rotates in the direction of the arrow I by 180 degrees from the position illustrated in FIG. 8B.

At this time, the cam 211*e* of the partially toothless gear unit 211 makes the sliding-contact portion. 211*r* contact the leaf spring 230 during rotation. When the cam 211*e* further rotates, the guide member 182 starts rotating (swinging) in the direction of the arrow H. When the partially toothless gear unit 211 rotates by a predetermined angle or more, the leaf spring 230 bends and the sheet discharge position illustrated in FIG. 8A results. Repetitively performing the above-described two different operations enables continuous two-sided printing in which the sheet P conveyed from the sheet conveyance path 203 is guided toward the sheet reversing conveyance path 202 and then guided toward the two-sided conveyance path 206.

<Description of Relation Between Guide Member and Sheet>

Next, the relationship between the guide member 182 and the sheet P will be described below. The relationship between the guide member 182 and the conveyed sheet P is almost similar to the relationship according to the first exemplary embodiment. The present exemplary embodiment is characterized in that the contact pressure onto the sheet P when the guide member 182 contacts the preceding sheet P1 having been conveyed in the sheet reversing conveyance path 202 is determined by the elastic force produced according to the bending of the leaf spring 230. Therefore, the effect of reducing image failures can be further improved by setting as small as possible the elastic force of the leaf spring 230 that overcomes the urging force of the tension spring 217 to achieve the state illustrated in FIG. 8A.

As described above, the present exemplary embodiment enables not only acquiring a similar effect to the effect according to the first exemplary embodiment but also further enhancing the effect of reducing image failures, making it possible to acquire an effect that the structure can be further simplified.

Although the present exemplary embodiment has been described above using the electrophotographic image forming apparatus 100 as an example, the present exemplary embodiment is also applicable, for example, to an ink-jet image forming apparatus for forming an image on a sheet by discharging ink liquid from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-256506, filed Dec. 28, 2015, which is hereby incorporated by reference herein in its entirety.

What is claimed is:

1. A sheet conveyance apparatus comprising:

a conveyance unit configured to convey a sheet;

a guide member configured to be movable between a first position in which the guide member guides the sheet conveyed by the conveyance unit toward a first conveyance path and a second position in which the guide member guides the sheet conveyed by the conveyance unit toward a second conveyance path;

a holding member for holding the guide member at the first position;

a first urging member configured to apply an urging force to the holding member so that the guide member is held at the first position; and a second urging member configured to apply, to the guide member, an urging force in a direction for moving the guide member from the first position to the second position, wherein the holding member is movable between a hold position in which the holding member holds the guide member at the first position against the urging force of the second urging member and a release position in which the holding member releases a holding of the guide member by going further away from the guide member than the hold position, and wherein, due to movement of the holding member from the hold position to the release position during conveyance of the sheet along the first conveyance path, the guide member moves from the first position to the second position and comes into contact with the sheet in the first conveyance path.

2. The sheet conveyance apparatus according to claim 1, wherein, due to movement of the holding member from the release position to the hold position during conveyance of the sheet along the second conveyance path, the guide member moves from the second position to the first position and comes into contact with the sheet.

3. The sheet conveyance apparatus according to claim 1, further comprising;

a rotary member; and an actuator configured to perform an operation for stopping a rotation of the rotary member after the rotary member rotates by a predetermined amount, wherein the holding member rotates between the hold position and the release position according to the predetermined amount of rotation of the rotary member.

4. The sheet conveyance apparatus according to claim 3, wherein the rotary member includes a drive input gear that rotates in one direction, a first partially toothless gear, and a second partially toothless gear.

5. The sheet conveyance apparatus according to claim 4, wherein the actuator includes an arm member that comes into engagement with the first partially toothless gear to stop rotation of the first partially toothless gear.

6. An image forming apparatus comprising:

an image forming unit that forms an image on a sheet; and the sheet conveyance apparatus according to claim 4 that conveys the sheet on which the image has been formed by the image forming unit.

7. The image forming apparatus according to claim 6, wherein the first conveyance path is a discharge conveyance path for discharging the sheet on which the image has been formed by the image forming unit to a sheet discharge unit, and wherein the second conveyance path is a reversing conveyance path for conveying the sheet on which the image has been formed by the image forming unit toward the image forming unit again.

8. The sheet conveyance apparatus according to claim 1, wherein the urging force by the second urging member acting on the guide member is smaller than the urging force of the first urging member acting on the guide member via the holding member.

9. A sheet conveyance apparatus comprising:

a conveyance unit configured to convey a sheet;

a guide member configured to be movable between a first position in which the guide member guides the sheet conveyed by the conveyance unit toward a first conveyance path and a second position in which the guide member guides the sheet conveyed by the conveyance unit toward a second conveyance path;

a holding member for holding the guide member at the first position;

a first urging member configured to apply an urging force to the holding member so that the guide member is held at the first position;

a second urging member configured to apply, to the guide member, an urging force in a direction for moving the guide member from the first position to the second position;

a rotary member; and an actuator configured to perform an operation for stopping a rotation of the rotary member after the rotary member rotates by a predetermined amount, wherein the holding member rotates between a hold position in which the holding member holds the guide member at the first position against the urging force of the second urging member and a release position in which the holding member releases a holding of the guide member by going further away from the guide member than the hold position, according to the predetermined amount of rotation of the rotary member.

10. A sheet conveyance apparatus comprising:

a conveyance unit configured to convey a sheet;

a guide member configured to be movable between a first position in which the guide member guides the sheet conveyed by the conveyance unit toward a first conveyance path and a second position in which the guide member guides the sheet conveyed by the conveyance unit toward a second conveyance path;

a holding member for holding the guide member at the first position;

a first urging member configured to apply an urging force to the holding member so that the guide member is held at the first position; and a second urging member configured to apply, to the guide member, an urging force in a direction for moving the guide member from the first position to the second position, wherein the holding member is movable between a hold position in which the holding member holds the guide member at the first position against the urging force of the second urging member and a release position in which the holding member releases a holding of the guide member by going further away from the guide member than the hold position, and wherein the urging force by the second urging member acting on the guide member is smaller than the urging force of the first urging member acting on the guide member via the holding member.

* * * * *